US006675412B2

(12) United States Patent
Faucher et al.

(10) Patent No.: US 6,675,412 B2
(45) Date of Patent: Jan. 13, 2004

(54) WINCH ASSEMBLY FOR THE DISPLACEMENT OF A PERSON BETWEEN A FIRST VERTICAL POSITION AND A SECOND VERTICAL POSITION

(75) Inventors: Martin Faucher, Katevale (CA); Michel Corriveau, Quebec (CA); Michel Moliner, Quebec (CA)

(73) Assignee: BHM Medical Inc., Magog (CA)

( * ) Notice: Subject to any disclaimer, the term of this patent is extended or adjusted under 35 U.S.C. 154(b) by 0 days.

(21) Appl. No.: 10/214,115

(22) Filed: Aug. 8, 2002

(65) Prior Publication Data

US 2003/0200607 A1 Oct. 30, 2003

Related U.S. Application Data

(63) Continuation-in-part of application No. 09/662,917, filed on Sep. 15, 2000, now abandoned.

(51) Int. Cl.[7] ..... A61G 7/14
(52) U.S. Cl. ..... 5/83.1; 5/87.1; 294/82.11
(58) Field of Search ..... 5/81.1 R, 83.1, 5/84.1, 85.1, 87.1, 89.1; 294/82.11, 81.56, 81.61, 81.62, 81.51, 81.54, 82.1

(56) References Cited

U.S. PATENT DOCUMENTS

| | | | | |
|---|---|---|---|---|
| 245,502 A | | 8/1881 | Jacobsen | |
| 286,202 A | | 10/1883 | Jacobsen | |
| 2,125,546 A | | 8/1938 | Corr | |
| 2,975,434 A | | 3/1961 | Butler et al. | |
| 3,131,404 A | | 5/1964 | Bowers et al. | |
| 4,136,903 A | * | 1/1979 | Roethler | 294/81.61 |
| 4,580,317 A | * | 4/1986 | Timothy | 452/187 |
| 5,005,233 A | | 4/1991 | Toivio et al. | |
| 5,018,933 A | * | 5/1991 | Kramer | 414/542 |
| 5,239,713 A | | 8/1993 | Toivio et al. | |
| 5,269,579 A | * | 12/1993 | DeCrane | 294/81.56 |
| 5,327,593 A | | 7/1994 | Burnett | |
| 5,809,591 A | * | 9/1998 | Capaldi et al. | 5/83.1 |
| 6,006,377 A | * | 12/1999 | Asakawa | 5/83.1 |
| 6,085,368 A | | 7/2000 | Robert et al. | |
| 6,174,010 B1 | | 1/2001 | Fanger et al. | |
| 6,219,862 B1 | * | 4/2001 | Horcher et al. | 5/89.1 |
| 6,389,618 B1 | * | 5/2002 | Flynn | 5/81.1 R |
| 6,523,195 B1 | * | 2/2003 | Rodier et al. | 5/83.1 |

FOREIGN PATENT DOCUMENTS

| | | |
|---|---|---|
| DE | 831440 A | 3/1952 |
| DE | 1541340 A | 9/1969 |
| DE | 2460858 A | 6/1976 |

* cited by examiner

*Primary Examiner*—Michael F. Trettel
(74) *Attorney, Agent, or Firm*—Ronald S. Kosie; Robert Brouillette; Gaétan Prince

(57) ABSTRACT

A winch assembly for the displacement of a person between a first vertical position and a second vertical position comprising:

a winch for displacing a person in a harness between said first and second vertical positions;

a first winch attachment means for realizably engaging said harness, said first winch attachment means being attached to said winch for the displacement of a person between said first and second vertical positions; and a second winch attachment means for realizably attaching the winch to an overhead support, the improvement wherein said first attachment means comprises two opposed support arms and displacement means associated with each said support arms whereby at least part of each arms is displaceable between a working extended position for engaging said harness and a non-working retracted position.

The winch has a reduced or more compact aspect during non-working periods as well as in the case of a moving of the winch assembly during non-working periods.

7 Claims, 11 Drawing Sheets

WINCH ASSEMBLY FOR THE DISPLACEMENT OF A PERSON BETWEEN A FIRST VERTICAL POSITION AND A SECOND VERTICAL POSITION

This application is a continuation of U.S. patent application Ser. No. 09/662,917, filed on Sep. 15, 2000, which is now abandoned.

FIELD OF THE INVENTION

The present invention relates to an improvement in a person lowering and raising winch assembly.

BACKGROUND OF THE INVENTION

A winch assembly for the displacement of a person between a first vertical position and a second vertical is illustrated in U.S. Pat. No. 6,085,368, the entire contents of which is incorporated herewith by reference. As shown in this U.S. patent a winch assembly may comprises:

- a winch for displacing a person in a harness between first and second vertical positions;
- a first winch attachment means for releasably engaging said harness, said first winch attachment means being attached to said winch for the displacement of a person between said first and second vertical positions; and
- a second winch attachment means for releasably attaching the winch to an overhead support.

In the winch assembly described in U.S. Pat. No. 6,085,368, a first attachment means is illustrated by the support element arms represented, in FIG. 14, by the elements (150) and (152) and in FIG. 16 by the elements (160) and (162). These elements are rigidly attached to the support structure of the body of the winch (140) in a permanent (i.e. rigid) configuration; these elements extend outwardly from the body of the winch. Such a structure gives rise to a number of drawbacks. The attachment means, for example, may injure people during non-working periods and/or during moving of the assembly from one place (i.e room) to one another. Additionally, the attachment means gives the winch a relative bulky aspect which renders storage and transportation difficult.

There is therefore a continuing need for a new winch assembly for the displacing of a person between a first and a second vertical position and which may have reduced or more compact aspect during non-working periods as well as in the case of a moving of the winch assembly during non-working periods.

SUMMARY OF THE INVENTION

Accordingly the present invention provides a winch assembly for the displacement of a person between a first vertical position and a second vertical position comprising:

- a winch for displacing a person in a harness between said first and second vertical positions;
- a first winch attachment means for releasably engaging said harness, said first winch attachment means being attached to said winch for the displacement of a person between said first and second vertical positions; and
- a second winch attachment means for releasably attaching the winch to an overhead support, characterized in that the first attachment means comprises two opposed support arms and displacement means associated with each said support arm whereby at least part of each arm is displaceable between a working extended position for engaging said harness and a non-working retracted position.

The displacement means can take any necessary form provided it may perform its purpose. It may for example be a telescopic means or a pivotally articulated means.

The first attachment means may for example be one of which is at least partially displaceable and which allows a quick engagement and disengagement of the harness and a stable retention of the harness during transportation of a person. Such attachment means which may be telescopically extendable support arms or pivotally articulated support arms.

In accordance with the present invention, the attachment means may, for example, comprise two opposed support arms which in working position extend outwardly from the body of the winch and substantially symmetrically on a same horizontal line.

The present invention also relates to a person lowering and raising assembly comprising a support structure and a winch assembly according to the first aspect of the invention.

BRIEF DESCRIPTION OF THE DRAWINGS

In drawings which illustrate example embodiments of the present invention:

FIG. 6*e* is a view seen according to the direction of the arrow B of the component of the retractable arm represented in FIG. 6*d.*

Referring to FIG. 1, this figure illustrates a system, known from the prior art document U.S. Pat. No. 6,085,368, showing a winch assembly attached to a downwardly extending trolley carriage projection (4) such that the body (2) of the winch assembly is upwardly and downwardly displaceable in the direction of the double leaded arrow 2*a*. The elongated member (3) of the winch assembly is attached to a trolley via the carriage projection (4). The trolley is engaged in a track (5) which is attached to a ceiling. The elongated member (3) of the winch assembly may be attached to the downwardly extending carriage projection (4) in any suitable releasable (e.g. by a hook, by a nut/bolt attachment system, etc . . . , ) or permanent fashion. As shown in Figure (1) the free end (7) of the elongated member (3) may be attached to the downwardly extending carriage projection (4) by a hook/eyelet combination, i.e. by hook (6) and eyelet (8). The other end of the elongated member (3) is attached to an internal mechanism placed inside the body (2) of the winch. The internal mechanism allows the displacement of the body of the winch between a first vertical position and a second vertical position. An example of such a mechanism is described in more detail in U.S. Pat. No. 6,085,368.

Figure 1:
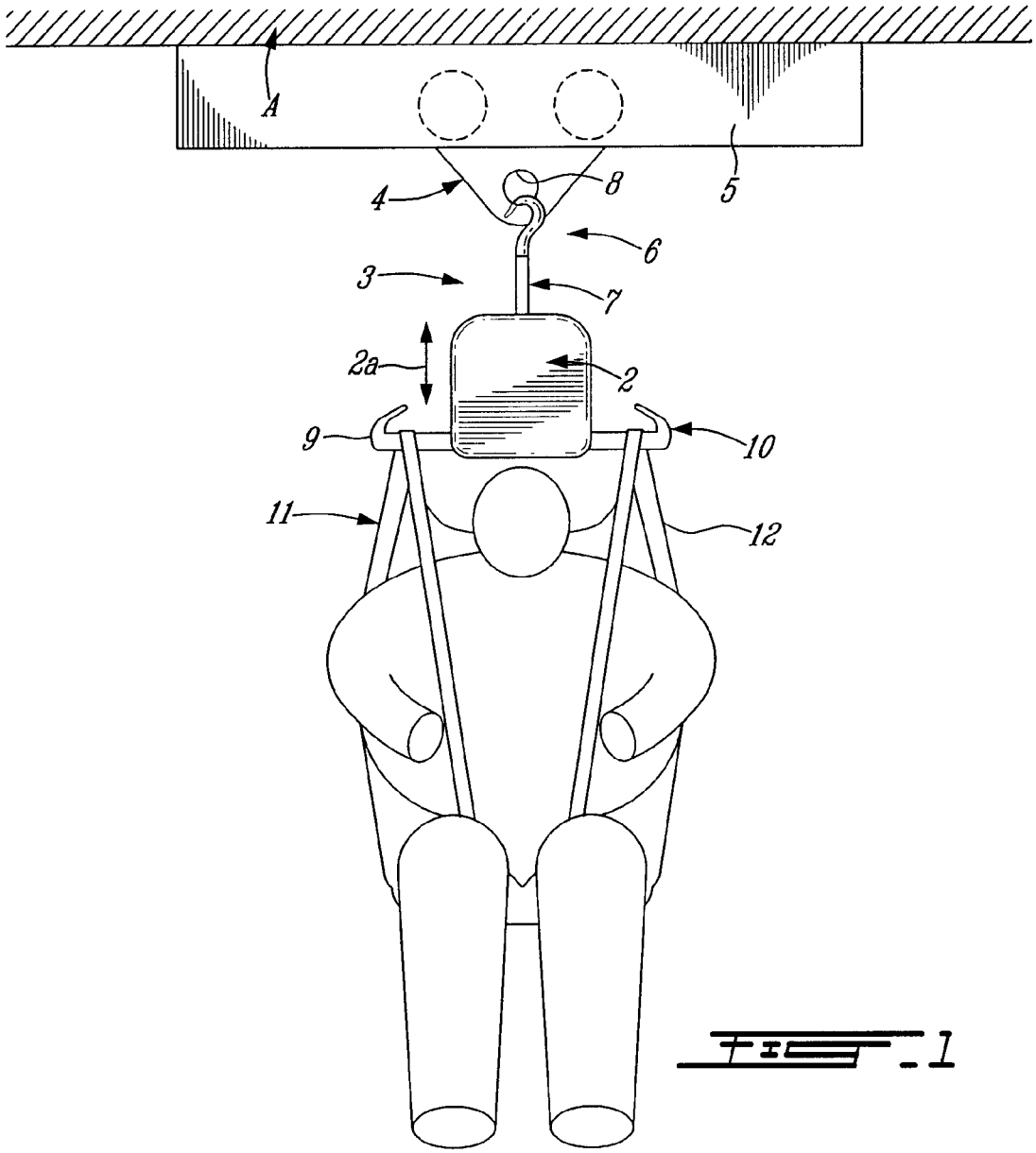
FIG. 1 illustrates a winch assembly in a person handling system according to the prior art document U.S. Pat. No. 6,085,368 wherein the elongated harness support members are rigidly fixed to the body of the winch, i.e. the harness support member have a single configuration.

The winch assembly as seen in the FIG. 1 includes a support arm component for releasable engagement with a patient carrying harness or sling. The support arm component however comprises a pair of opposed rigid support arm elements (9,10) rigidly fixed to the body (2) of the winch assembly on opposite sides thereof. Each support arm has a structure and a form allowing the releasably engagement of a respective portion of a patient harness. In the case represented in FIG. 1, the harness support straps (11) and (12) are each releasably wrapped or hung over a respective support arm element.

As may be appreciated, the above described winch assembly may be transported between patient stations provided with suitable trolley/track combinations; i.e. only this element of a person handling system needs to be transferred between patient stations. However such a winch assembly is not only voluminous and therefore relatively difficult to transport but also may present a danger since the extending support arms may injure persons.

Figure 2:
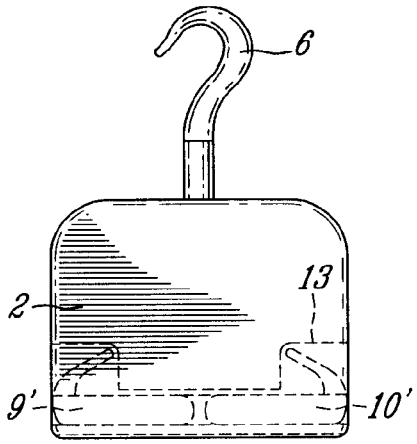
FIG. 2 is a schematic illustration of an example of a winch assembly according to the invention wherein the harness support arms are retractable (telescopic) arms and are represented in non-working position.
Figure 3:
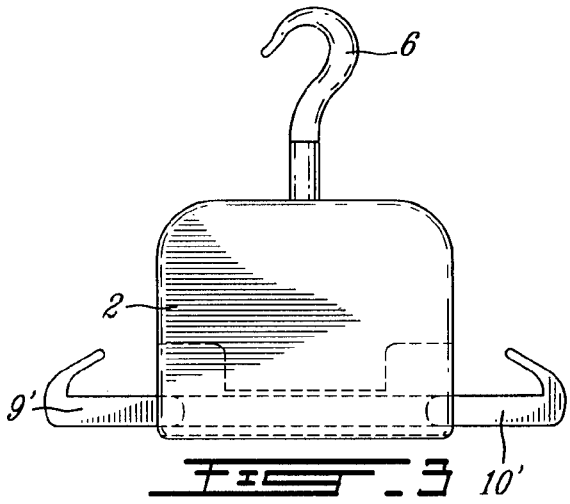
FIG. 3 illustrates the winch assembly as shown in FIG. 2 but wherein the harness support arms are represented in working extended position.

Turning to FIGS. 2 and 3, these figures schematically illustrate an example embodiment of the present invention having an elongated member terminated by a hook (6). The winch assembly is provided with a pair of arm assemblies each of which have working and non-working configurations. Each arm assembly has a respective support arm element (9') or (10').

As represented in FIG. 2, each of the opposed support arm elements (9', 10') are telescopically attached to the structure of the winch assembly. In FIG. 2, the arm elements are shown in a non-working retracted position as being withdrawn inside a single storage cavity (13) present in the body (2) of the winch assembly. The cavity (13) has a form and a size adapted to the form and to the size of the telescopically retractable support arms. In the retracted position , the winch assembly is particularly compact, this facilitate an easy and safe transportation. The opposed support arms (9', 10') may be withdrawn any desired predetermined degree from the cavity (13).

As represented in FIG. 3, the opposed support arms (9',10') are shown in a fully extended working position so as to extend horizontally and outwardly of the storage cavity (ies) (13) of the winch. In this position or configuration, the support arms (9') and (10') are able to releasably attach to a person harness for the transportation of a person.

Figure 4:
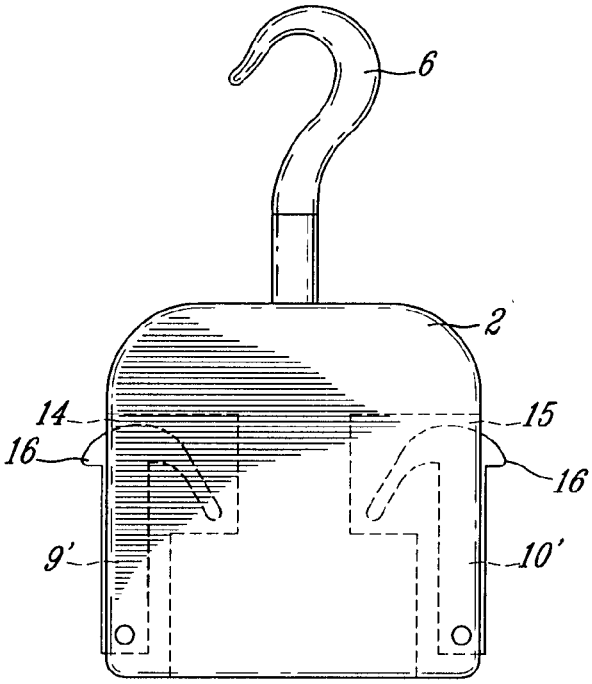
FIG. 4 is a schematic illustration of another example embodiment of a winch assembly according to the invention, wherein the harness support arms are pivotly attached to the body of the winch and are represented in non-working position.
Figure 5:
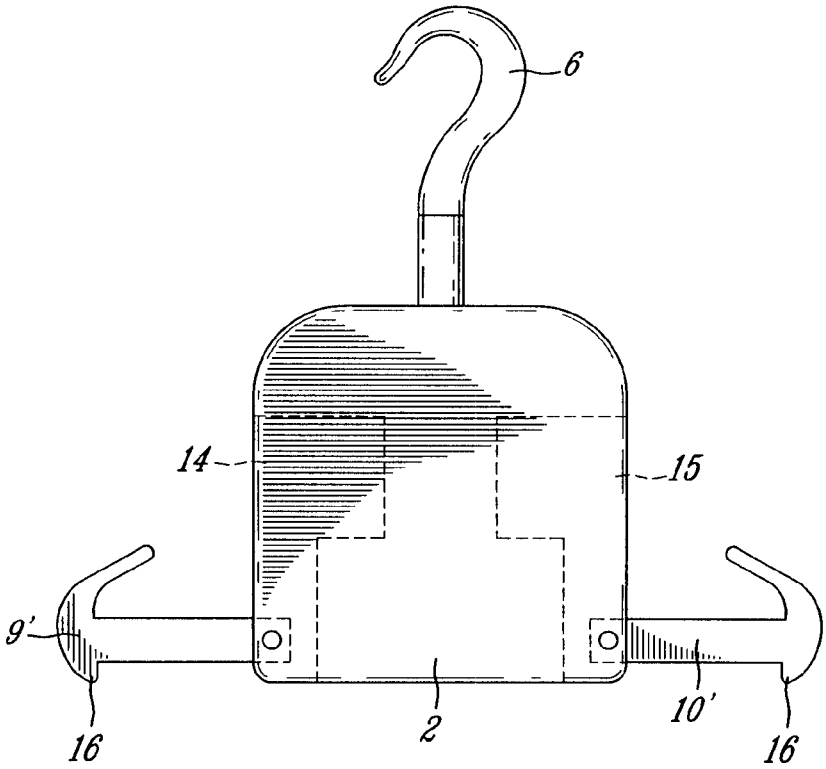
FIG. 5 illustrates the winch assembly as shown in FIG. 4 but wherein the harness support arms are represented in working position.

FIGS. 4 and 5 schematically illustrates another example embodiment of the present invention. For this embodiment the retractable support arm elements (9') and (10') are pivotally attached to the body (2) of the winch. As shown in FIG. 4, the retractable support arm elements (9') and (10') are folded up inside respectively the grooves (14) and (15) which act as storage cavities present inside the body (2) of the winch.

FIG. 5 shows support arm elements (9') and (10') in a working position (or configuration) characterised in that the support arms extend outwardly from the lateral sides of the winch. In this position the support arms (9') and (10') are able to be releasably attached to a person harness for the transportation of a person. To facilitate extraction of the arms from respective storage grooves, the support arms (9', 10') may be provided with finger pinch grip protuberances (16) present on the hooked head of the support arms (9',10').

FIGS. 6*a*, 6*b*, 6*c*, 6*d* and 6*e* illustrate in more detail an example of an articulated version of the present invention. These Figures illustrate retractable support arm elements (19, 20) pivotally attached to (elongated) protuberances (17, 18) which are rigidly attached to the body (2) of the winch.

Figure 6A:
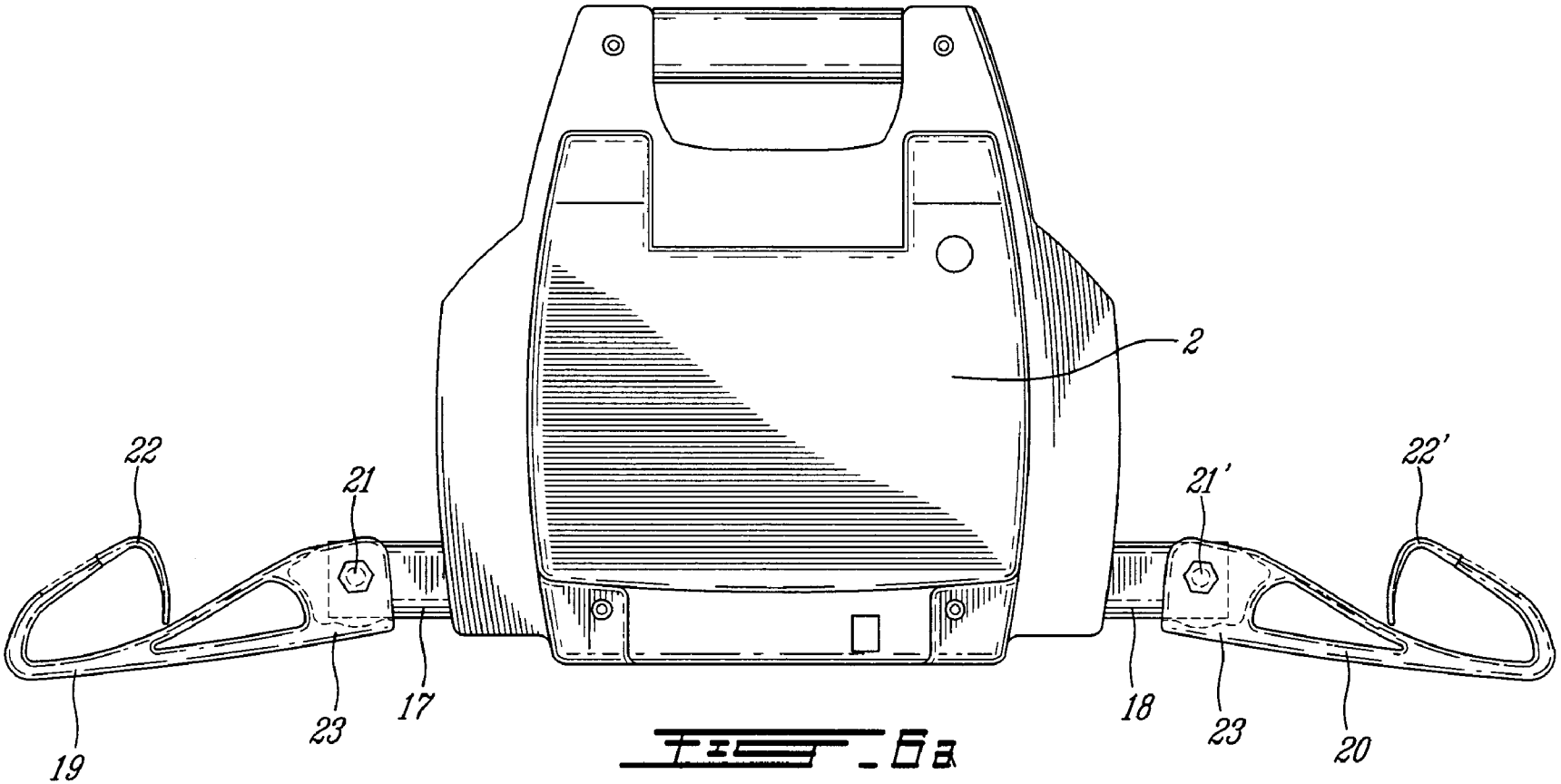
FIG. 6*a* is a more detailed illustration of an example embodiment of a winch assembly according to the invention with two pivotally retractable arms represented in working position.

FIG. 6*a* illustrates the support arm elements (19) and (20) as being in a working extended position. The retractable support arm elements (19) and (20) are pivotally attached respectively by screws (21, 21') to the elongated protuberances (17) and (18) of the body of the winch (7). The protuberances each extends outwardly from the lateral sides of the winch (2); the protuberance elements (17, 18) are rigidly attached to or are part of the body (2) of the winch i.e. each protuberance is fixed in any suitable manner to the body of the winch assembly (e.g. integral with, welded to, bolt to, etc . . . ). In a working position the hooked support arms (19) and (20) [which are terminated by hooks (22,22')] allow the realisable symmetrical attachment of a person harness. The hooks facilitate safe transportation of a person. The support arms (19,20) are pivotally attached to the protuberance elements (17, 18) by the pivot pin (21). As represented in FIG. 6*a*, the biased (curved) end of the hooks (22,22') prevent unwanted detachment of the harness. The biased (curved) end of the hook may be equipped with a spring in order to better prevent unwanted detachment of the harness.

Figure 6B:
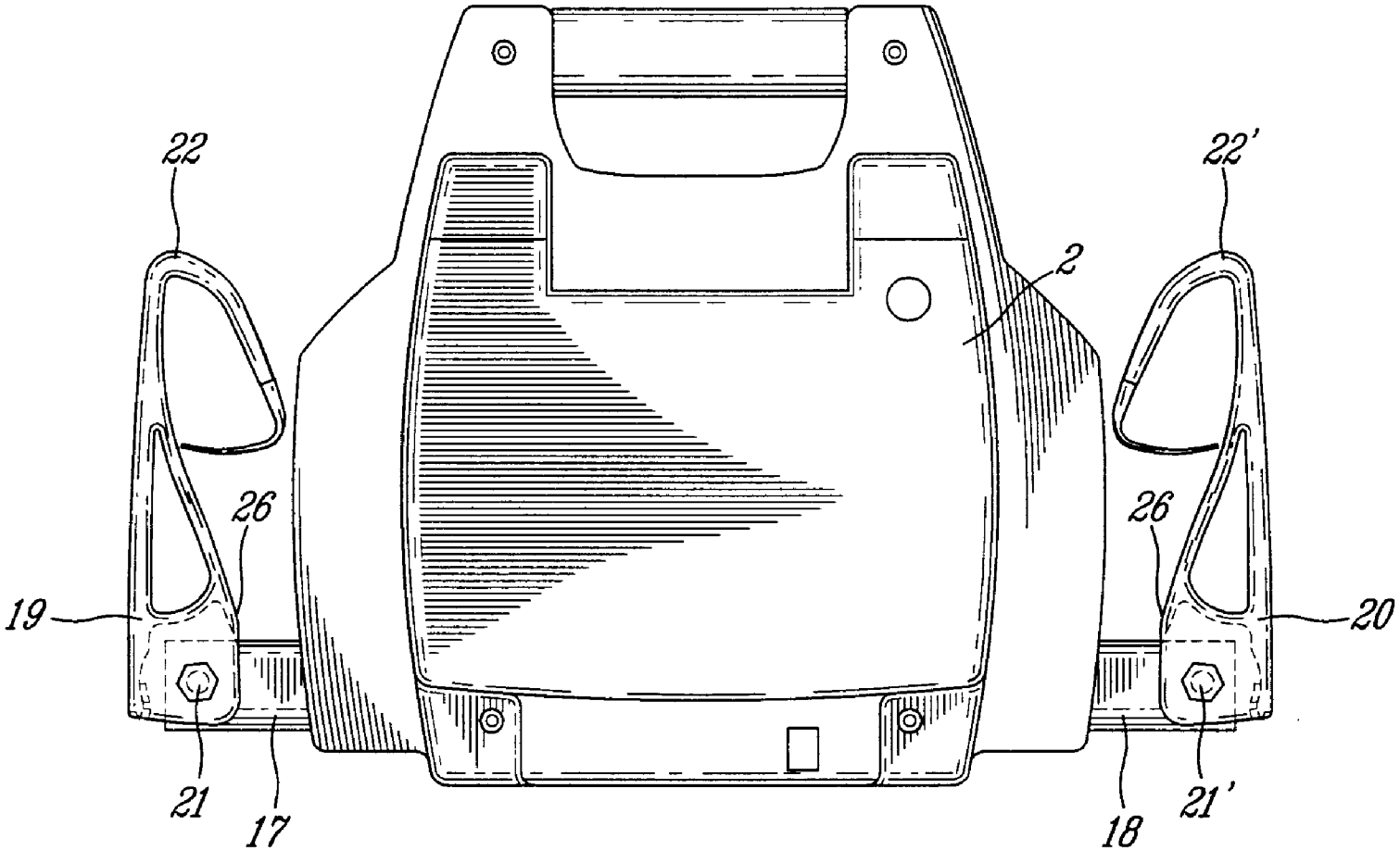
FIG. 6*b* is a view of the winch assembly shown in FIG. 6*a* but with the two pivotally retractable arms, represented in non-working position.

FIG. 6*b* shows the support arm elements in a non-working position wherein the support arm elements (19) and (20) extend upwardly more or less in parallel fashion to the lateral side walls of the body (2) of the winch. In this position, the winch may be easily stored or transported from one room to one another.

Figures 6A, 6C, 6D:
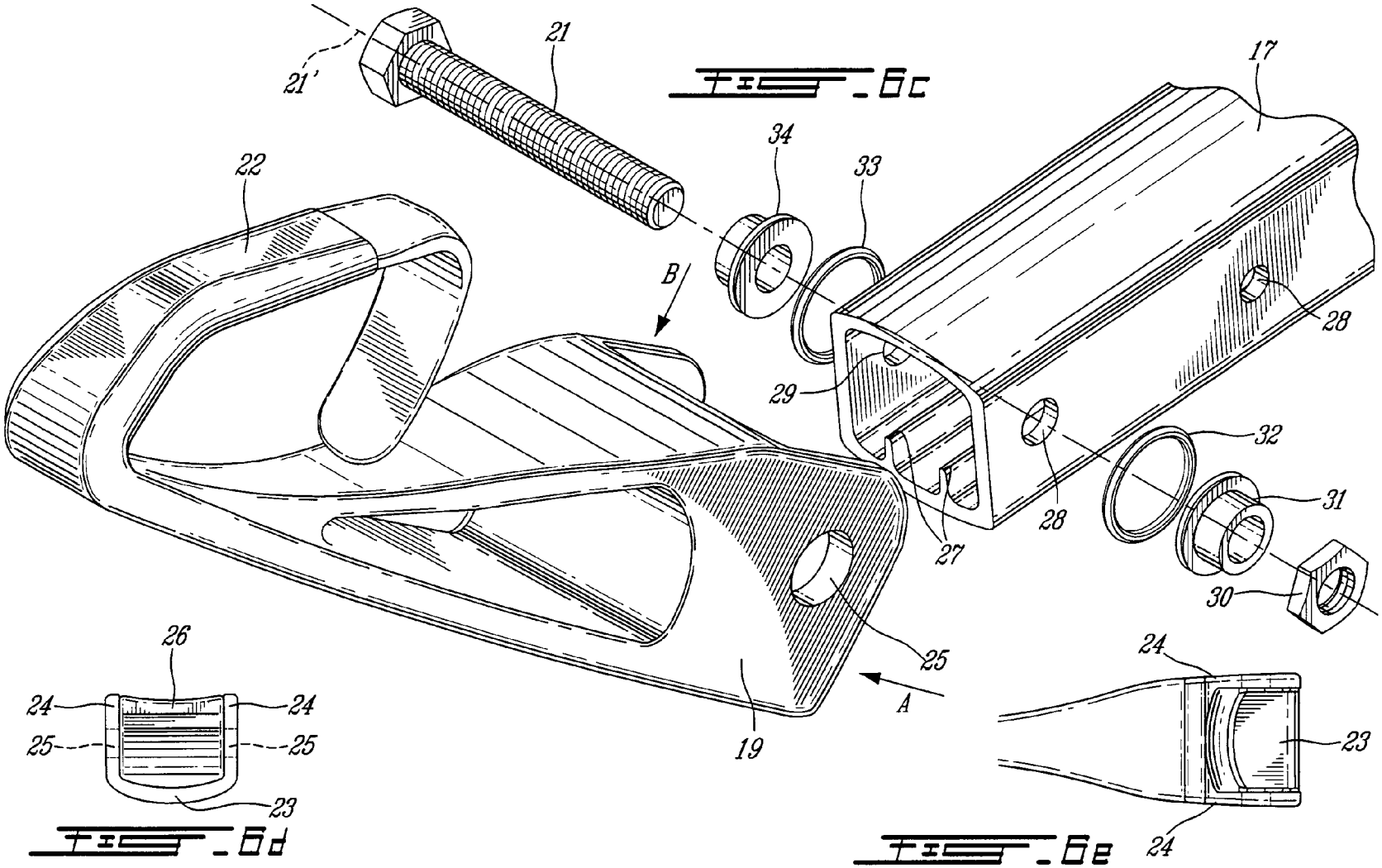
FIG. 6*c* is a partial exploded perspective view of a retractable arm as shown in FIG. 6*a;*
FIG. 6*d* is a view seen according to the direction of the arrow A of a component of the retractable arm represented in FIG. 6*c;*

FIG. 6*c* shows in perspective and more detail the constituting parts of an articulated support arm assembly comprising the support arm element (19) and the protuberance element (17). The end of the support arm element (19) opposite to the hooked end has a wall structure having a U-shaped cross-section.

FIGS. 6*d* and 6*e* show in closer detail the U-shaped wall member of the retractable support arm element (19). The U-shaped wall member is configured so as to be pivotally articulated with the elongated member (17). The U-shaped formed wall member is constituted by a first wall element (23), by two parallel wall elements (24) which are perpendicular to the first wall element (23) i.e. the wall elements (24) are spaced apart by a rim (26) limited by both vertical walls (24). The walls (24) are pierced with opposed cylindrical holes (25). As may be appreciated from FIG. 6*a*, the wall (23) limits the rotation of the support arm element in the extended working position. In the extended working position, the wall (23) comes into contact with the external surface of the lower horizontal wall of the elongated member (19) so as to inhibit further downward rotation. The protuberance (17) is constituted by an hollow (parallelepipedal) elongated member. The lower internal face of the protuberance (17) may have reinforcement ribs (27).

The rim (26) of the support arm elements (19, 20) limits the rotation of said support arm in retracted non-working position. Two opposed walls of the body of the protuberance (17) are each pierced by two cylindrical holes (28,29) so as to receive a thread bolt (21). In assembled configuration, each of the cylindrical holes (28,29) is aligned with one of the pair of the opposed holes (25).

The support arm (19) is pivotally attached to the protuberance (17) by the thread bolt (21) such that the element (17) may be articulated around a pivot axis (21') passing along the threaded bolt (21). The bolt (21) traverses the aligned cylindrical holes (25) and (28) respectively in the walls of the support arm (19) and in the wall of the protuberance (17). The threaded bolt (21) is maintained in place by a screw-nut (30). A smooth and regular rotation of the support arm (19) around the thread bold (21) is facilitated by with bushings (31,34) and O-rings (32, 33).

The bushing (34) and the O-ring (33) are positioned between the head of the thread bolt (21) and the wall of the protuberance (17).

The bushing (31) and the O-ring (32) are positioned between the screw-nut (30) and the external side of the protuberance (17).

The bushings (31,34) assure a good pivot of the support arm and a better contact surface.

The O-rings (32,33) generate a friction which maintains the support arm (17) slidly active activ in the desired position.

The base of the support arm (19) is outwardly engaged (seated within U-shaped formed wall member) with the extremity of the protuberance (17).

According to an another embodiment of the invention the base of the support arm (19) may be internally (seated outside the U-shaped formed wall member) engaged with the extremity of the protuberance (17).

FIG. 7*a*, 7*b*, 7*c*, 7*d* and 7*e* illustrate in more details another example embodiment of the invention wherein support arm assemblies have elements which are telescopically retractable.

Figure 7A:
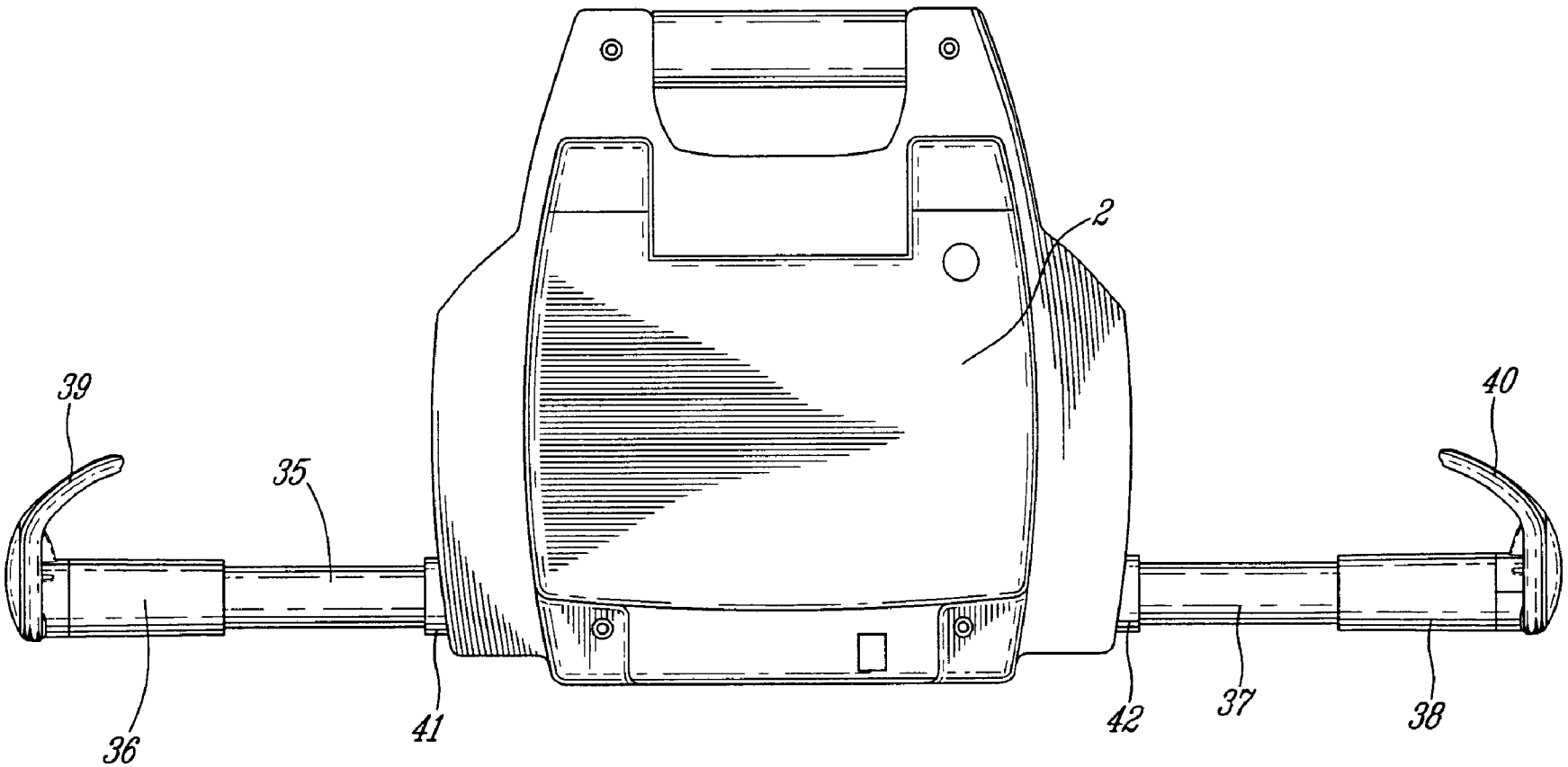
FIG. 7*a* is a more detailed illustration of a front view of a further example embodiment of a winch assembly with two telescopically extendable support arms in working position.

Referring to FIG. 7*a*, the telescopic support arms assemblies each comprise support arm elements each having two parts (35,36) and (37,38) respectively. The elongated arm elements may have a cylindrical aspect as shown in FIG. 7*a*. The parts (36) and (38) have a diameter which is larger than the diameter of the cylindrical part (35) and (37) and are terminated respectively by hook ends (39) and (40). As may be gleaned from FIGS. 7*c*, 7*d* and 7*e*, parts (35) and (37) of the telescopic support arms are slidely engaged respectively in the hollow sleeve elements (41) and (42); please see FIGS. 7*c*, 7*d* and 7*e* for more detail. The telescopic support arm element as seen in FIG. 7*a* are shown as being in an extended working position. In this position, the telescopic support arm elements allow the releasable attachment of a person harness and the transportation of a person.

Figure 7B:
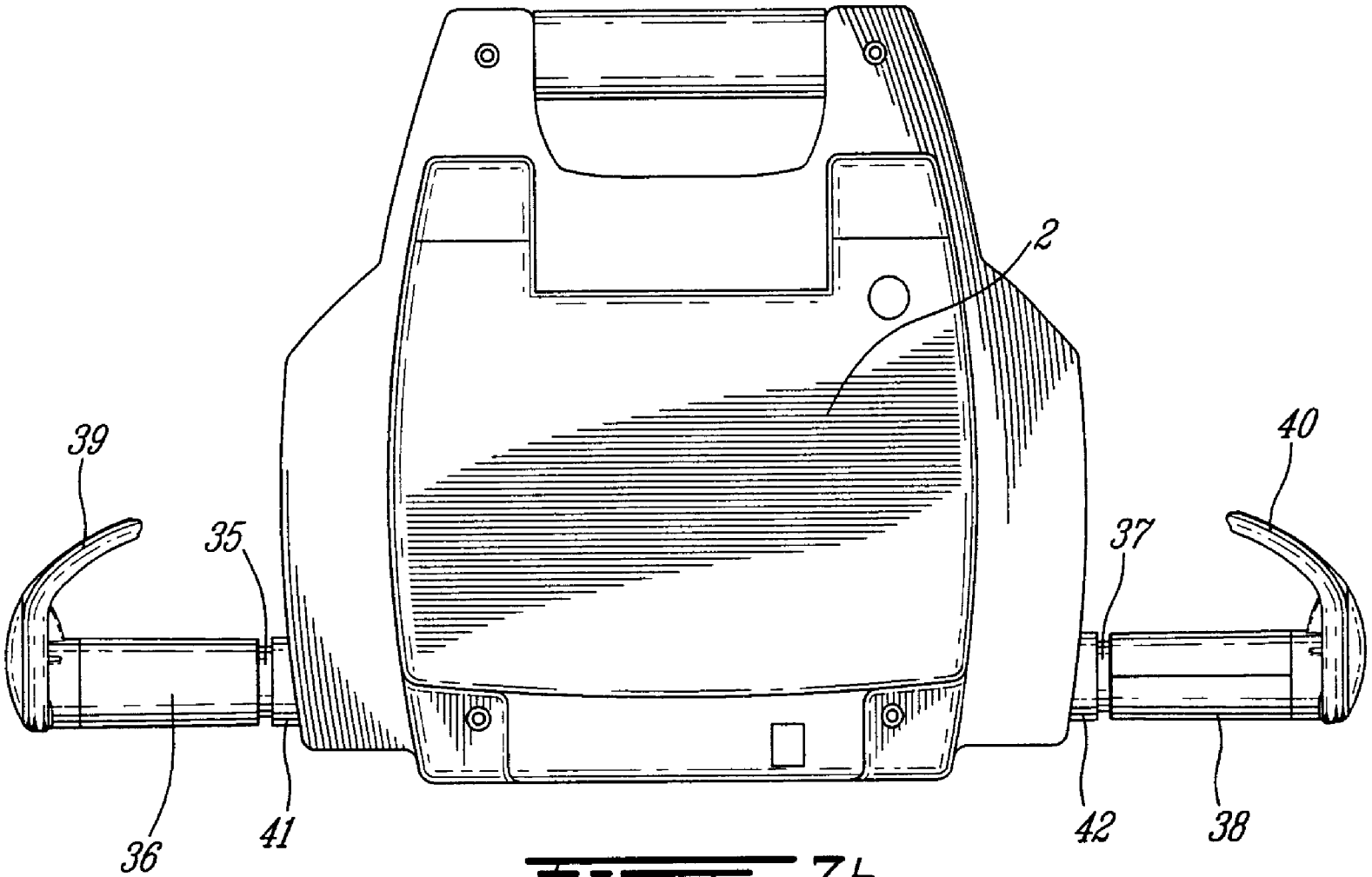
FIG. 7*b* is a view of the winch assembly shown in FIG. 7*a* but with the two telescopically extendable support arms in non-working position.

FIG. 7*b* represents the winch illustrated in FIG. 7*a* in a non-working configuration wherein the elongated (cylindrical) members (35) and (37) are nearly completely engaged in the (cylindrical) sleeve elements (41) and (42) which may be an integral part of the body (2) of the winch. This position of the support arm elements facilitate the storage and/or transportation of the winch assembly.

Figure 7C:
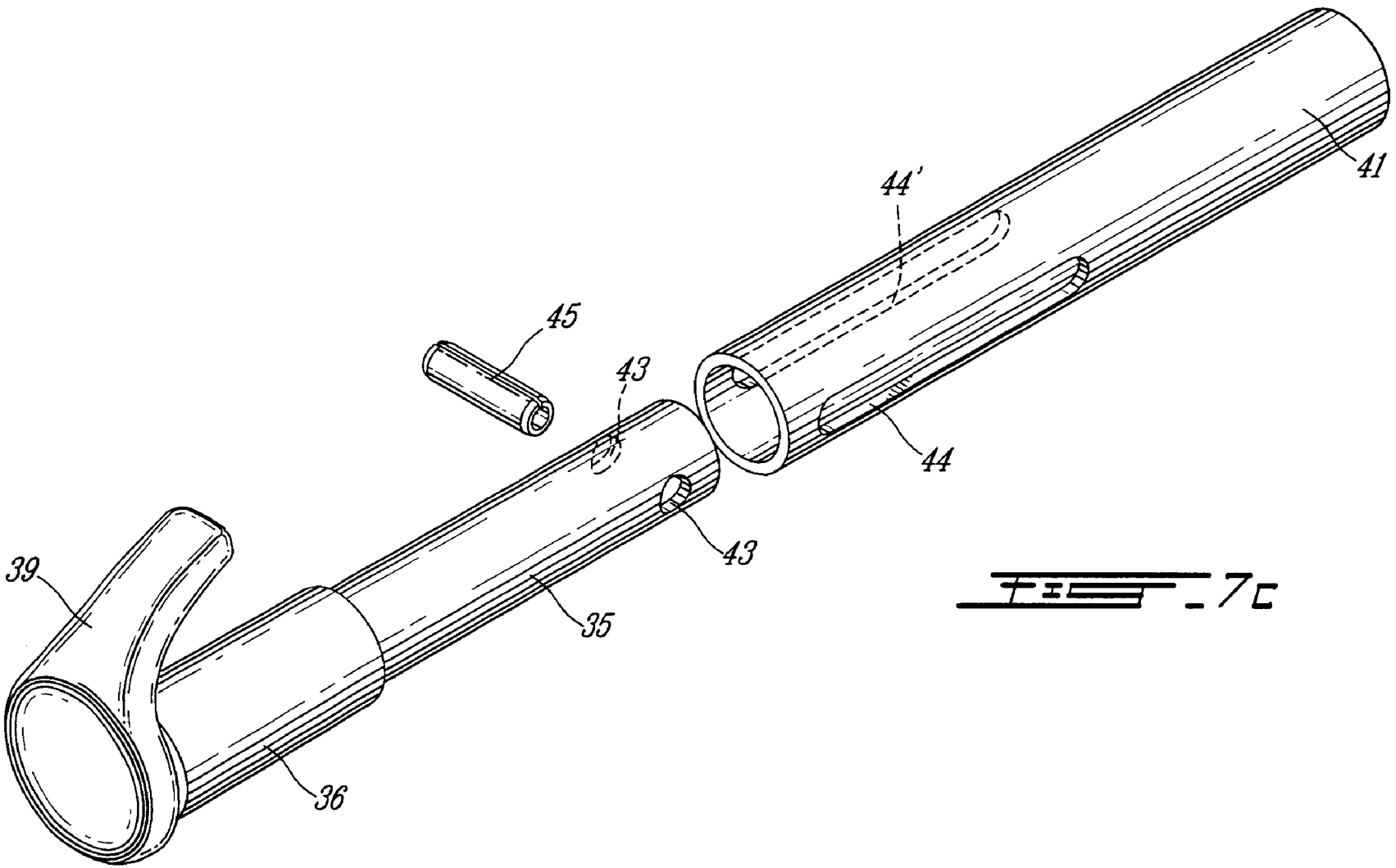
FIG. 7*c* is a partial exploded perspective view of a telescopically extendable arm assembly of the winch assembly as shown in FIG. 7*a;*

FIG. 7*c* is a more detailed perspective view of a telescopic support arm assembly referred to with respect to FIG. 7*a*. The (cylindrical) (hollowed) elongated member (35) of the telescopic support arm element has two opposed (cylindrically) holes (43). The (cylindrical) sleeve element (41) is perforated by two grooves (44,44'). The sleeve element (41) is rigidly attached to the body of the winch in any suitable fashion. The (cylindrical) member (35) is sized so as to slidingly engage the inside wall of the cylindrical member (41). The pin (45) is fixedly positioned, for example by press fit, perpendicularly to the sliding direction of the (cylindrical) member (35), in the cylindrical holes (43) when the elongated member (35) is internally engaged in the protuberance (41). The pin (45) limits rotational and longitudinal motion of the member (35). The sliding of the elongated member (35) in the elongated member (41) is limited by the sliding of the pin (45) between the ends of the grooves (44,44').

Figure 7D:
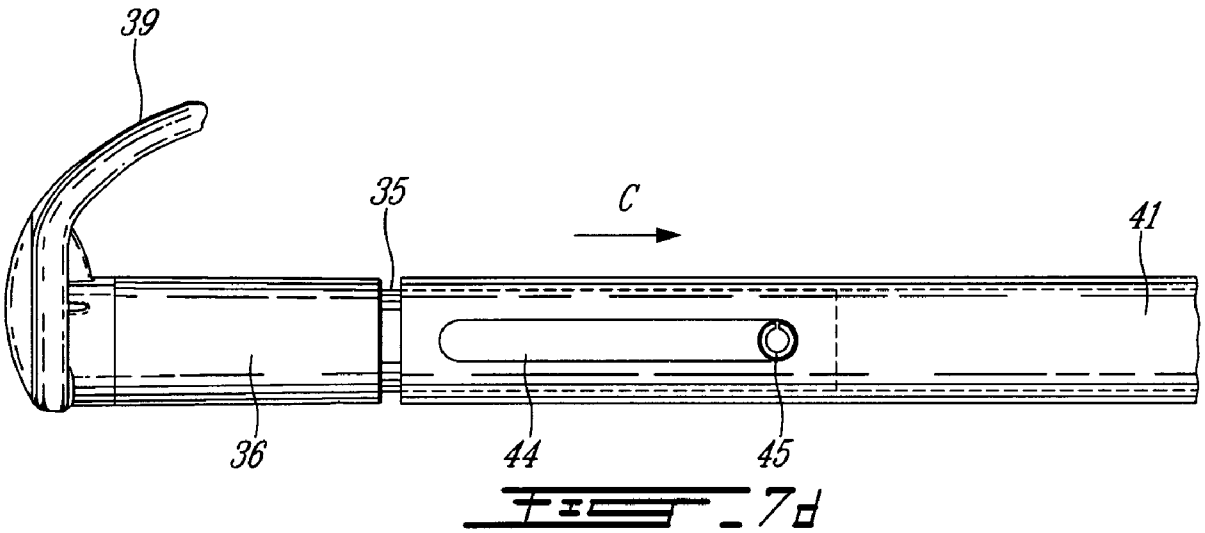
FIG. 7*d* is a side view of the telescopically extendable arm assembly shown in FIG. 7*c* and represented in a non-working configuration.

FIG. 7*d* represents the telescopic support arm assembly as detailed in FIG. 7*a*, in non-working position. The sliding of the elongated member (35) inside the hollowed cylindrical member (41), in the direction of the arrow C, is limited by the contact of the pin (45) with the reward end of the groove (44).

Figure 7E:
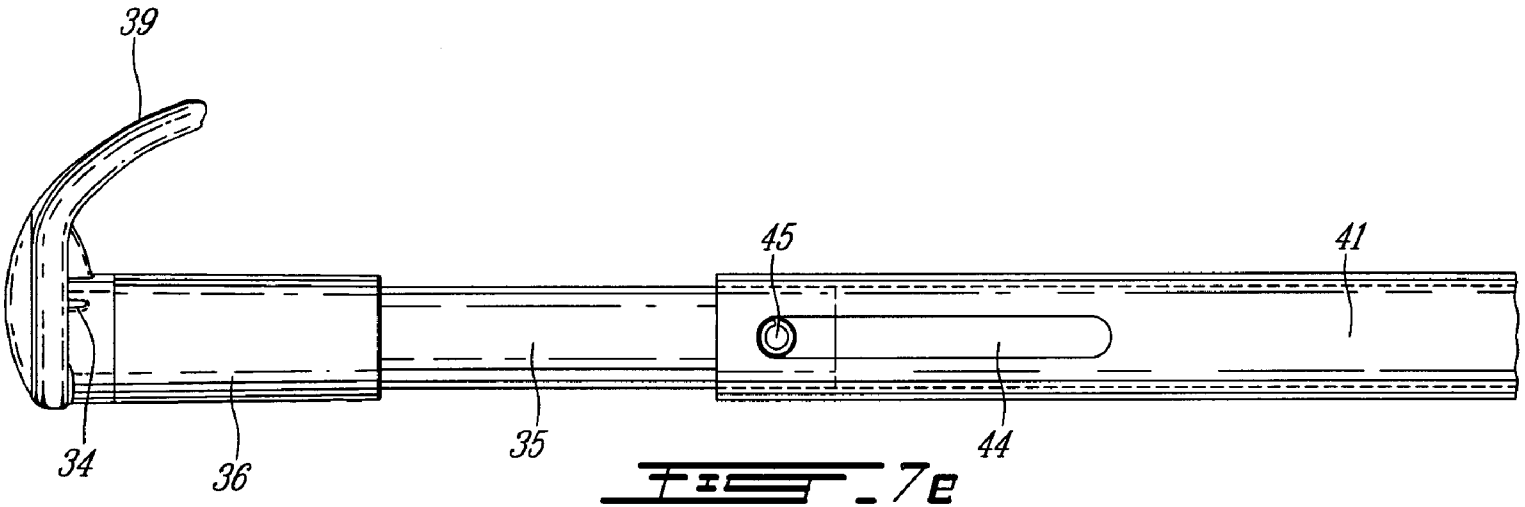
FIG. 7*e* is a side view of the telescopically extendable arm assembly shown in FIG. 7*c*, represented in a working position.

FIG. 7*e* shows the telescopic support arm represented in FIG. 7*a* in working position wherein the position of the elongated member (35) inside the hollowed cylindrical member (41) is determined by the contact of the pin (45) with the reward end of the groove (44). The extend of the sliding of the elongated member (35) inside the elongated member (41) corresponds to the length of the grooves (44).

Figure 8:
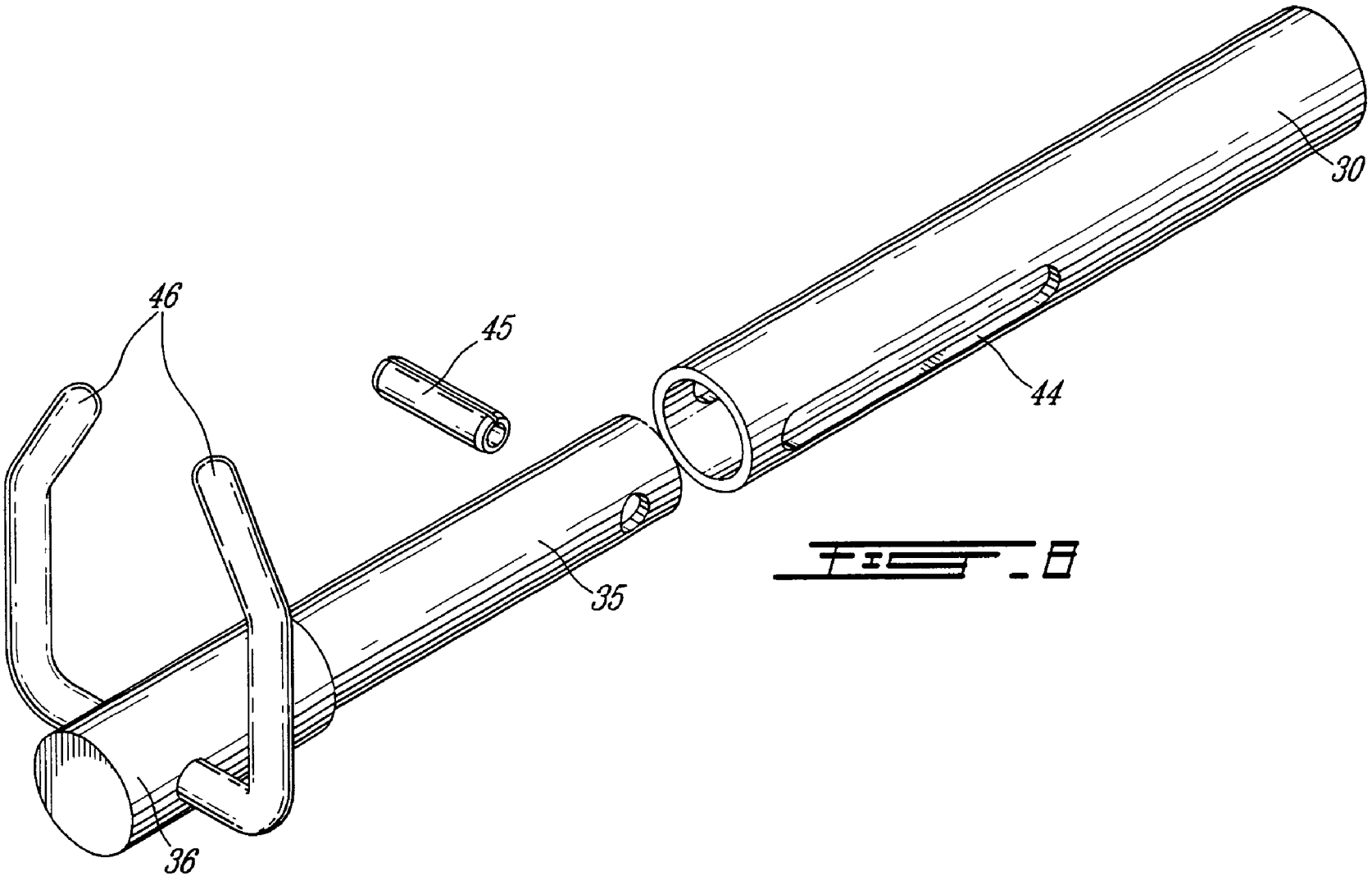
FIG. 8 is a partially exploded perspective view of a further embodiment of a telescopically extendable support arm assembly according to the invention, which extendable support arm is equipped with a two hook head.

FIG. 8 represents in a perspective detailed view a telescopic support arm similar to the telescopic support arm represented in FIG. 7*c* except that the attachment extremity is equipped with two hooks (46) symmetrically attached to the body of the external cylindrical extremity (36).

Figure 9:
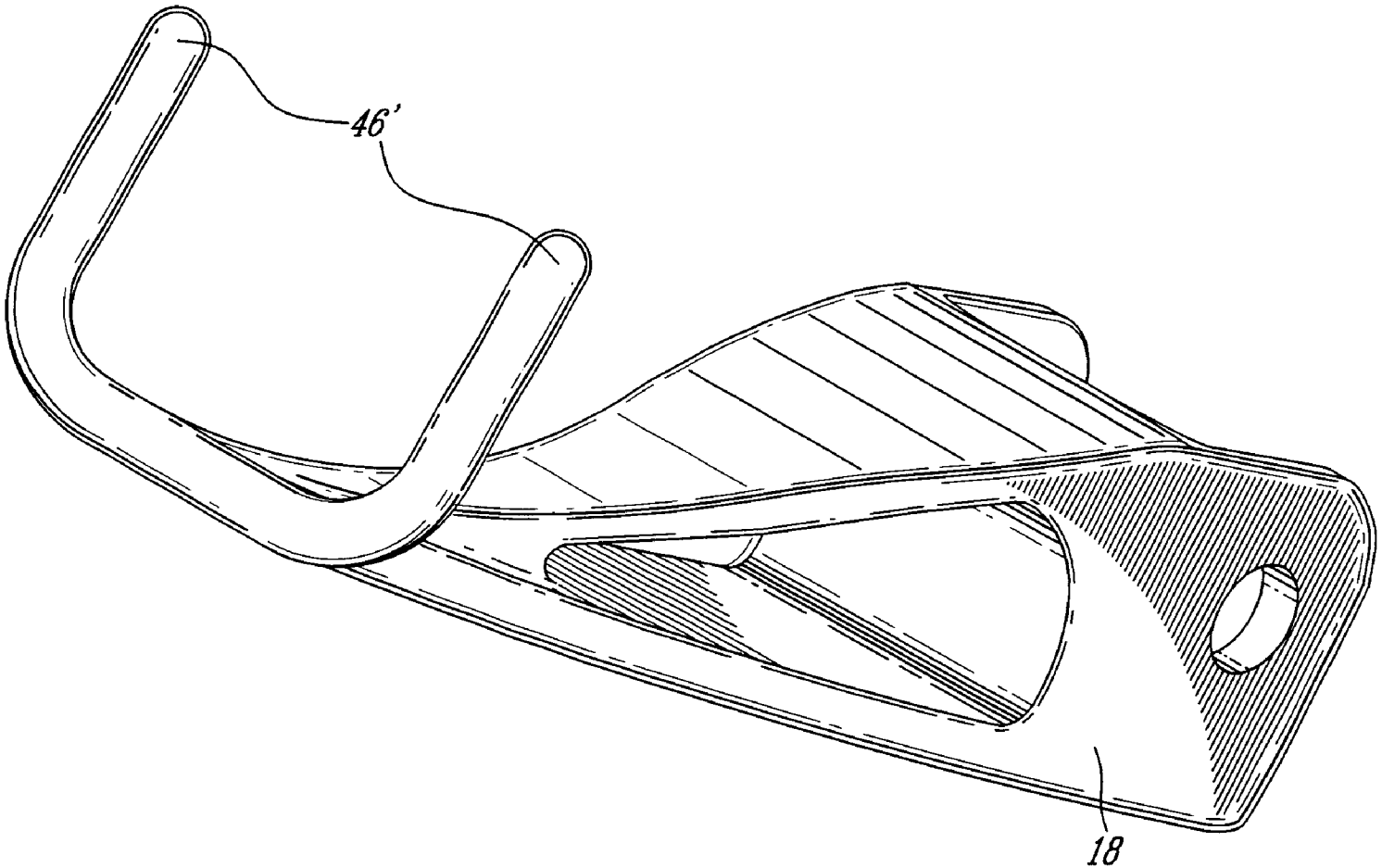
FIG. 9 is a partially exploded perspective view of the extremity of an additional embodiment of a pivotally articulated support arm component according to the invention equipped with a two hook head.

FIG. 9 represents in a perspective detailed view a retractable arm similar to the retractable support arm represented in FIG. 6*a* except that the attachment extremity is equipped with two hooks (46') symmetrically attached to an extremity of the support arm (19).

As may be appreciated from the above, the non-working position of support arms is illustrated on FIGS. 2, 4, 6*b* and 7*d*, also called storage position allows the easy and safe moving of the winch assembly from one room to an another.

The retention means at one end of the support arm may have any form but is preferably hook-formed and more preferably is any spring biased two hook-formed as represented in FIGS. 8 and 9.

The support arms do not necessarily need lock means in working position since the weight of the carried person will maintain said support arms in the appropriate predetermined working position. However, the body (2) of the winch may be equipped with blocking means assuring the maintenance of the support means in the housing. Such means may be for examples springs or retractable abutment.

The winch assembly of the present invention may include any kind of winch of the mechanical or of the electrical type, provided the winch may assume the displacement i.e. the lifting and the lowering of a person in a harness, between a first position and a second position, both positions being located on a same vertical axis.

While preferred embodiments of the invention have been described and shown in the drawings, many modifications thereof may be made by a person skilled in the art without departing from the spirit of the invention, that I do not mean to be limited to the details of construction herein shown and described other than as defined in the appended claims.

We claim:

1. In a winch assembly for the displacement of a person between a first vertical position and a second vertical position comprising:

a winch for displacing a person in a harness between said first and second vertical positions;

a first winch attachment means for realizably engaging said harness, said first winch attachment means being attached to said winch for the displacement of a person between said first and second vertical positions; and a second winch attachment means for realizably attaching the winch to an overhead support, the improvement wherein said first attachment means comprises two opposed support arms and displacement means associated with each said support arms whereby at least part of each arms is displaceable between a working extended position for engaging said harness and a non-working retracted position.

2. A winch assembly as defined in claim 1 wherein at least part of the opposed support arms are telescopically extendable between a working extended position for engaging said harness and a non-working retracted position.

3. A winch assembly as defined in claim 1 wherein at least part of the opposed support arms are articulated arms displaceable between a working extended position for engaging said harness and a non-working retracted position.

4. A winch assembly according to claim 1 wherein the opposed support arms extends on a common axis.

5. A winch assembly according to claim 1 wherein the opposed support arms comprise blocking means configured so as to inhibit unwanted displacements of said support arms during the displacement of said person.

6. A winch assembly according to claim 2 wherein the telescopically extendable support arms consist of at least two elongated elements, one of the elongated elements being slidely engaged in the other elongated element.

7. A winch assembly according to claim 3, wherein the articulated arms consist of a pair of elongated members and respective pivot means for pivotally attaching a respective elongated member to the body of the winch.

* * * * *

UNITED STATES PATENT AND TRADEMARK OFFICE

CERTIFICATE OF CORRECTION

PATENT NO. : 6,675,412 B2
APPLICATION NO. : 10/214115
DATED : January 13, 2004
INVENTOR(S) : Martin Faucher et al.

It is certified that error appears in the above-identified patent and that said Letters Patent is hereby corrected as shown below:

In the Claims:

Claim 1, col. 7, line 29 and col. 8, line 1, "realizably" should read -- releasably --.

Signed and Sealed this
Sixteenth Day of September, 2014

Michelle K. Lee

Michelle K. Lee
*Deputy Director of the United States Patent and Trademark Office*